US008847086B2

(12) United States Patent
Wojtak

(10) Patent No.: US 8,847,086 B2
(45) Date of Patent: Sep. 30, 2014

(54) LOCKOUT DEVICE

(75) Inventor: Ray Wojtak, Waterford, WI (US)

(73) Assignee: Master Lock Company LLC, Oak Creek, WI (US)

( * ) Notice: Subject to any disclaimer, the term of this patent is extended or adjusted under 35 U.S.C. 154(b) by 248 days.

(21) Appl. No.: 13/455,234

(22) Filed: Apr. 25, 2012

(65) Prior Publication Data

US 2012/0273330 A1 Nov. 1, 2012

Related U.S. Application Data

(60) Provisional application No. 61/479,055, filed on Apr. 26, 2011.

(51) Int. Cl.
*H01H 9/28* (2006.01)

(52) U.S. Cl.
CPC ..... *H01H 9/283* (2013.01)
USPC ..... 200/43.16

(58) Field of Classification Search
USPC ..... 200/43.09–43.16, 43.01–43.07, 200/43.18–43.21, 61.62, 61.66, 334, 50.02, 200/50.11, 321–322, 329–333
See application file for complete search history.

(56) References Cited

U.S. PATENT DOCUMENTS

| | | | | |
|---|---|---|---|---|
| 1,676,971 | A | 7/1928 | Weaver | |
| 4,079,214 | A | 3/1978 | Castonguay et al. | |
| 4,342,979 | A | 8/1982 | Phillips | |
| 5,039,829 | A | 8/1991 | Brucksch | |
| 5,147,991 | A | 9/1992 | Jordan, Sr. | |
| 5,165,263 | A | 11/1992 | Perron et al. | |
| 5,207,315 | A | 5/1993 | Benda | |
| 5,324,897 | A | 6/1994 | Melgoza et al. | |
| 5,543,593 | A | 8/1996 | Turek | |
| 5,598,724 | A | 2/1997 | Primeau | |
| 5,675,997 | A | 10/1997 | Hulak | |
| 5,808,252 | A | 9/1998 | Makuc et al. | |
| 5,868,242 | A | 2/1999 | Hall et al. | |
| 5,949,039 | A | 9/1999 | Koek et al. | |
| 6,076,380 | A | 6/2000 | Hulak | |
| 6,563,063 | B1 * | 5/2003 | Moore | 200/50.33 |
| 6,580,041 | B1 | 6/2003 | Ransopher | |
| 6,622,536 | B1 | 9/2003 | Fuller et al. | |
| 6,844,512 | B2 | 1/2005 | Benda | |

(Continued)

OTHER PUBLICATIONS

Printout of website http://www.skylox.com, The Aircraft Circuit Breaker Safety Solution, 5 pages.

(Continued)

*Primary Examiner* — Edwin A. Leon
(74) *Attorney, Agent, or Firm* — Calfee, Halter & Griswold LLP

(57) ABSTRACT

A lockout device for assembly with an instrument includes a housing and a cover. The housing defines an opening and includes a side wall at least partially defining an internal cavity sized to receive a head portion of an instrument, and a protrusion extending from an internal surface of the side wall and positioned to retain the head portion within the internal cavity when the head portion of the instrument is received in the internal cavity. The cover is assembled with the housing and moveable between a lockout position at least partially blocking the opening to secure the head portion of the instrument within the internal cavity, and a release position permitting withdrawal of the head portion of the instrument through the opening. A lock interface is configured for securing the cover in the lockout position.

24 Claims, 7 Drawing Sheets

(56) References Cited

U.S. PATENT DOCUMENTS

| | | | |
|---|---|---|---|
| 6,972,387 | B2 | 12/2005 | Berthaud |
| 7,371,980 | B2 | 5/2008 | Marshall |
| 7,442,888 | B2 | 10/2008 | Puddicombe, II et al. |
| 7,501,593 | B2 | 3/2009 | Brojanac |
| 7,845,367 | B2 | 12/2010 | Abe |
| 2003/0024284 | A1 | 2/2003 | Erickson |
| 2003/0038692 | A1 | 2/2003 | Schmalz |
| 2006/0070861 | A1* | 4/2006 | Bogdon et al. ..... 200/43.16 |

OTHER PUBLICATIONS

International Search Report and Written Opinion from International Application No. PCT1US12/34896 dated Jul. 16, 2012.

* cited by examiner

LOCKOUT DEVICE

CROSS-REFERENCE TO RELATED APPLICATION

This application claims the benefit of U.S. Provisional Patent Application Ser. No. 61/479,055, entitled "LOCKOUT DEVICE" and filed Apr. 26, 2011, the entire disclosure of which is incorporated herein by reference.

BACKGROUND

Automated devices, such as gas or electrically powered industrial equipment or vehicles, are often provided with a control panel or interface including one or more buttons, knobs, switches, or other instruments for altering an operating condition of the equipment. For example, a machine may be provided with an emergency shutoff button or switch to immediately turn off the machine in the event of a serious malfunction or other emergency. As another example, airplanes and other aircraft are typically provided with a control panel of button or plunger-operated circuit breaker devices. Each exemplary circuit breaker device has a button that is automatically extended (e.g., by popping out) or manually extended (e.g., by pulling) to break the circuit and that is depressed to complete the circuit. In many cases, it may be desirable or necessary to temporarily prevent further operation of the instrument, for example, to maintain a circuit disabling condition. While a locking door, lid, or other such covering may be provided on a control panel to prevent access to the instrument for which access is to be restricted, such an obstruction may be undesirable where operation of one or more instruments on the control panel is necessary or desired during the lockout of one or more other instruments on the same control panel.

SUMMARY

The present application describes lockout devices for use with user operable control instruments, such as, for example, plunger-style circuit breakers.

In one exemplary embodiment, a lockout device for assembly with an instrument includes a housing and a cover. The housing defines an opening and includes a side wall at least partially defining an internal cavity sized to receive a head portion of an instrument, and a protrusion extending from an internal surface of the side wall and positioned to retain the head portion within the internal cavity when the head portion of the instrument is received in the internal cavity. The cover is assembled with the housing and moveable between a lockout position at least partially blocking the opening to secure the head portion of the instrument within the internal cavity, and a release position permitting withdrawal of the head portion of the instrument through the opening. A lock interface is configured for securing the cover in the lockout position.

In another exemplary embodiment, a lockout device includes a housing and a cover. The housing includes a side wall at least partially defining an internal cavity sized to receive a head portion of an instrument, and a protrusion extending from an internal surface of the side wall and positioned to retain the head portion within the internal cavity. The housing defines an opening having a first portion sized to receive the head portion of the instrument and a second portion sized to receive a neck portion of the instrument. The cover is assembled with the housing and moveable between a lockout position at least partially blocking the first portion of the opening and a release position permitting withdrawal of the head portion of the instrument through the first portion of the opening. The device further includes a lock interface configured for securing cover in the lockout position.

In another exemplary embodiment, an instrument is provided in combination with a lockout device. The instrument extends from a control panel and includes a head portion extending in a lateral direction from a neck portion. The instrument is movable with respect to the control panel between an extended position and a retracted position. The lockout device includes a housing and a cover. The housing includes a side wall at least partially defining an internal cavity receiving the head portion of the instrument, and a protrusion extending from an internal surface of the side wall. The head portion of the instrument is retained within the internal cavity by the protrusion. The housing defines an opening having a first portion sized to permit withdrawal of the head portion of the instrument and a second portion receiving the neck portion of the instrument therethrough. The cover is assembled between first and second portions of the side wall. The cover is slideable between a lockout position at least partially blocking the first portion of the opening to secure the head portion of the instrument within the internal cavity, and a release position permitting withdrawal of the head portion of the instrument through the first portion of the opening. At least one of the housing and the cover includes a lock aperture positioned to receive a lock member when the cover is in the lockout position to secure the cover in the lockout position.

In still another exemplary embodiment, a method of preventing movement of an instrument with respect to a control panel is contemplated. A head portion of the instrument is inserted through a first portion of an opening in a housing of a lockout device, such that the head portion of the instrument is received in an internal cavity in the housing and a neck portion of the instrument extends through a second portion of the opening. A protrusion extending from an internal surface of the side wall blocks withdrawal of the head portion through the second portion of the opening. A cover assembled with the housing is slid to a lockout position in which the cover at least partially blocks the first portion of the opening to prevent withdrawal of the head portion of the instrument through the first portion of the opening. A lock member is secured through a lock aperture in at least one of the housing and the cover to secure the cover in the lockout position.

BRIEF DESCRIPTION OF THE DRAWINGS

These and other features and advantages of the invention will become apparent from the following detailed description made with reference to the accompanying drawings, wherein.

DETAILED DESCRIPTION

Figure 1B:
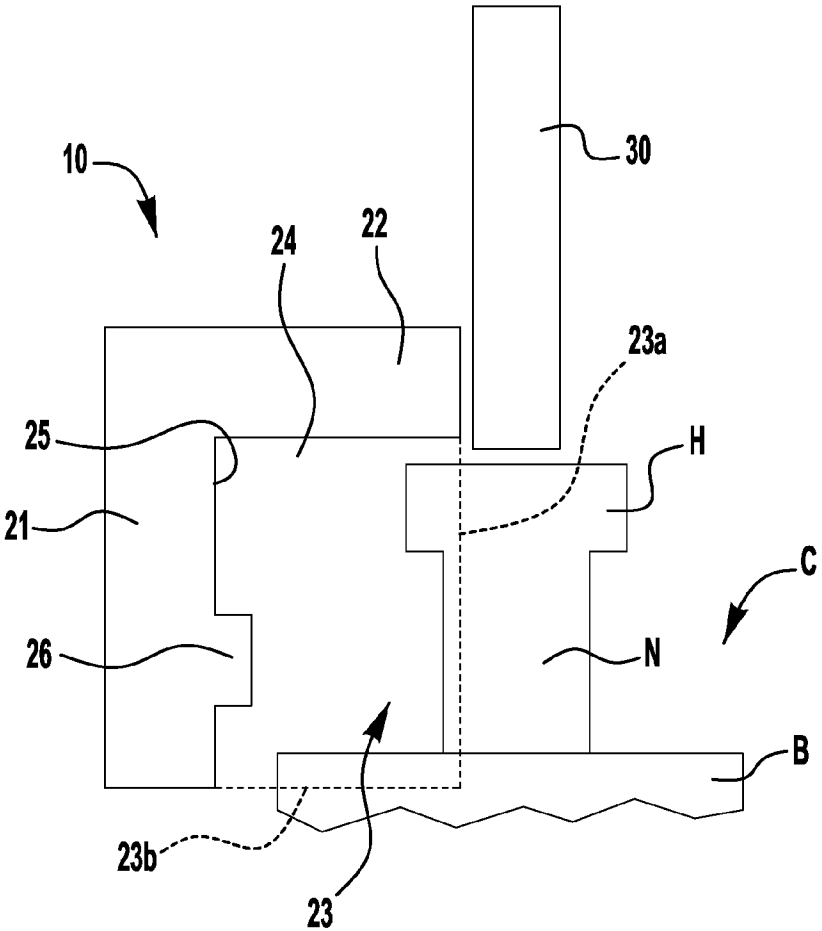
FIG. 1B is a schematic cross-sectional view of the lockout device of FIG. 1A, shown in a release position.

This Detailed Description describes exemplary embodiments and is not intended to limit the scope of the invention in any way. Indeed, the scope of the invention is broader than and unlimited by the preferred and exemplary embodiments, and the terms used have their full ordinary meaning Also, while the detailed exemplary embodiments described in the specification and illustrated in the drawings relate to a lockout device for a plunger-style circuit breaker, as conventionally used on aircraft control panels, it should be understood that many of the elements described herein may be applied to other types of lockout devices for use with other types of instruments, for example, other control instruments (either alone or on a control panel) such as buttons, switches, knobs, valve handles, etc. Further, the lockout device may be used with control panels in non-aircraft vehicles, buildings, and other applications.

The present application describes, in part, a lockout device for a control instrument that blocks or restricts operation of the instrument, and/or that blocks or restricts access to the instrument to prevent actuation or manipulation of the instrument. According to various exemplary embodiments, a lockout device may be configured to block or restrict operation of an instrument on a control panel while permitting access to one or more other instruments on the control panel. In one such embodiment, a lockout device may include a housing defining an opening for receiving an operable portion of an instrument into a cavity within the housing. A cover is assembled with the housing and is movable between a release position in which the lockout device may be installed on or removed from the instrument (e.g., the operable portion of the instrument may be inserted into or withdrawn from the lockout device cavity), and a lockout position in which removal of the lockout device from the instrument (or withdrawal of the operable portion of the instrument from the lockout device cavity) is blocked or restricted. In an exemplary embodiment, the cover may be secured in the lockout position by a locking member, which may be integral with or assembled to the lockout device. As one example, a padlock may be assembled with the lockout device to block movement of the cover into the release position.

Figure 1A:
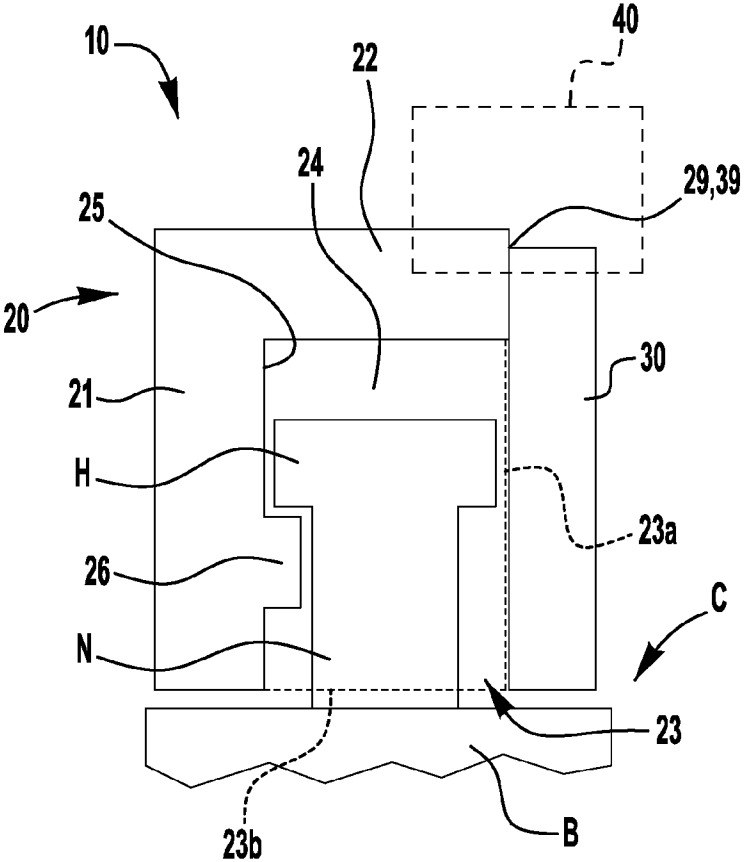
FIG. 1A is a schematic cross-sectional view of a lockout device secured to an instrument, according to an exemplary embodiment.
Figure 2:
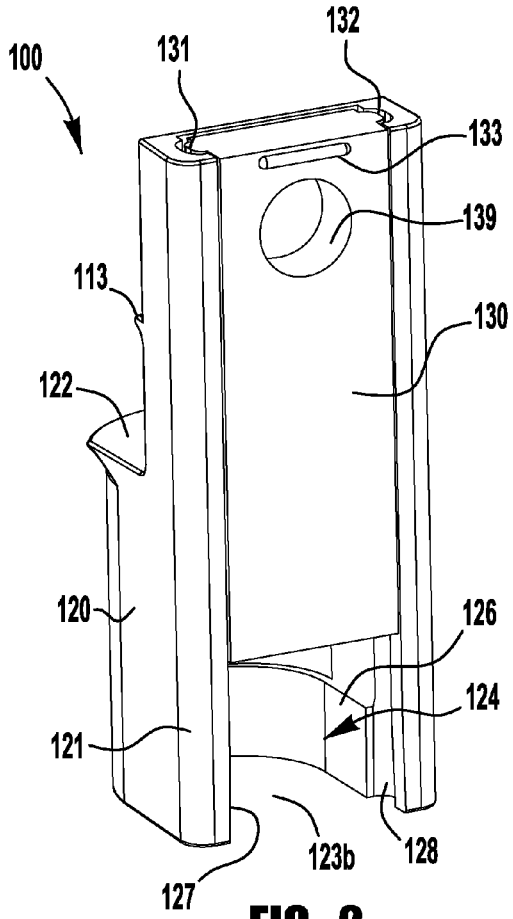
FIG. 2 is a front perspective view of a lockout device, shown in a release position, according to an exemplary embodiment.
Figure 3:
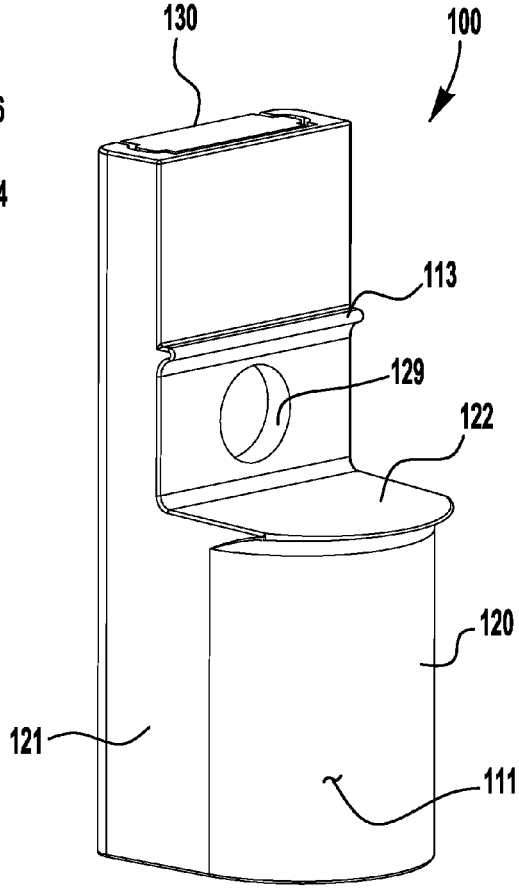
FIG. 3 is a rear perspective view of the lockout device of FIG. 2, shown in the release position.
Figure 4:
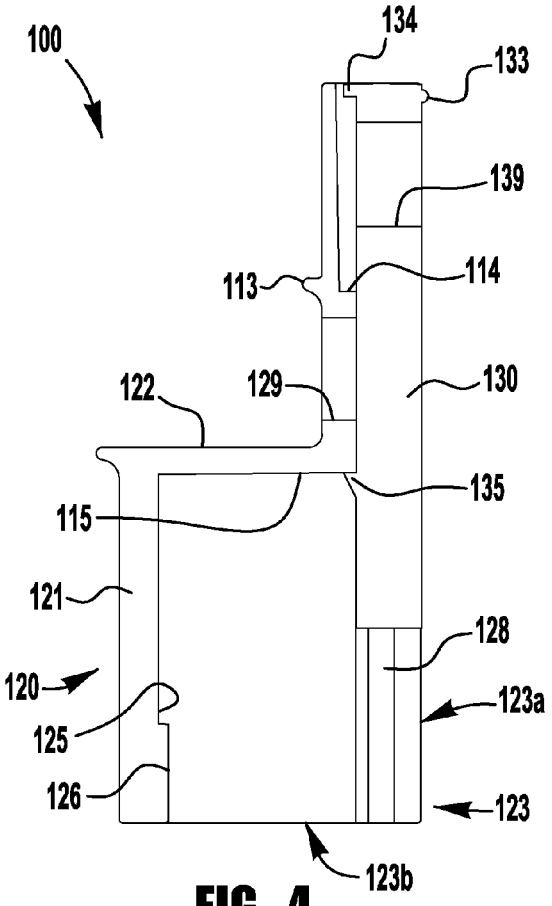
FIG. 4 is a side cross-sectional view of the lockout device of FIG. 2, shown in the release position.

In one exemplary embodiment, as shown schematically in FIGS. 1A and 1B, a lockout device 10 is configured to securely lock out an instrument C having an operable portion with a neck portion N extending from a base portion B (for example, a control panel, machine, or instrument body), and a head portion H extending laterally outward from the neck portion N. The lockout device 10 includes a housing 20 and a cover 30 assembled with the housing. The housing 20 includes a side wall 21 and an end wall 22 and defines an instrument receiving opening 23 including a side facing first portion 23*a* extending to a downward facing second portion 23*b*. The opening 23 may be sized such that the head and neck portions H, N of the instrument C are laterally receivable through the side facing portion 23*a* of the opening 23 for retention of the head and neck portions of the instrument C in an internal cavity 24 of the housing 20, with the neck portion N extending through the downward facing portion 23*b* of the opening 23 (see FIG. 1A). When the head and neck portions of the instrument are at least partially received in the cavity 24 of the lockout device housing 20, the cover 30 is movable from a release position to a lockout position at least partially blocking the side facing portion 23*a* of the opening 23 to prevent withdrawal of the operable portion of the instrument through the side facing portion 23*a* of the opening 23. To prevent withdrawal of the operable portion of the instrument through the downward facing portion 23*b* of the opening 23, one or more protrusions 26 may be provided on or extend from an internal surface 25 of the side wall 21 of the housing 20 and positioned to engage the laterally extending head portion of the instrument C. In a lockout position, a locking arrangement (represented schematically at 40), may be used to engage or interlock with a lock interface 29, 39 of one or both of the housing 20 and the cover 30 to prevent movement of the cover 30 to the release position.

To remove the lockout device 10 from the instrument C, the locking arrangement 40 is disengaged from the lock interface 29, 39, and the cover 30 is moved to the release position, allowing the head H of the instrument C to be withdrawn from the side facing portion 23*a* of the opening 23 (see FIG. 1B).

In various exemplary embodiments, many different types of housing and movable cover arrangements may be used, including pivotable, rotatable, detachable, and sliding arrangements. In one embodiment, an cover includes a plate that is received in the opening of the lockout device housing and that is configured to slide between lockout and release positions. A lock aperture may be provided in either or both of the housing and the cover, such that when a padlock shackle is inserted through the lock aperture, movement of the cover from the lockout position to the release position is obstructed.

Figure 5:
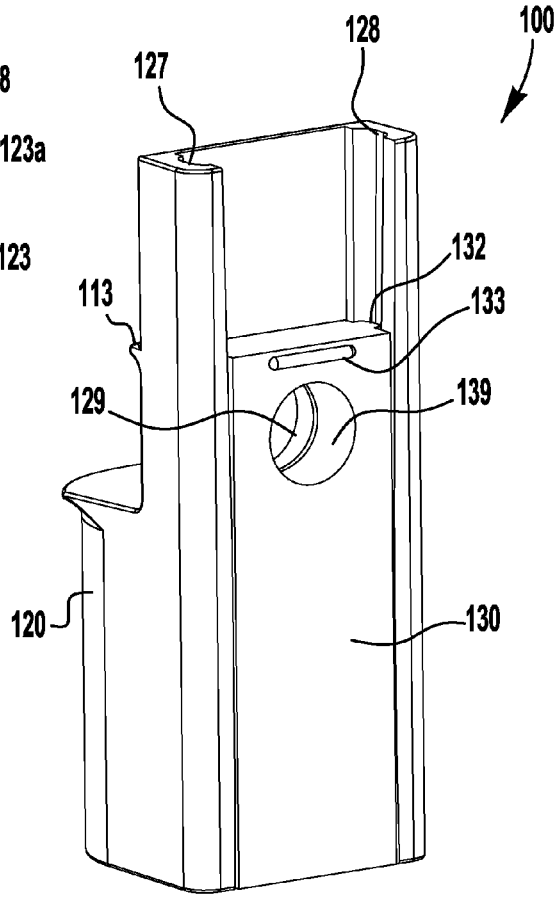
FIG. 5 is a front perspective view of the lockout device of FIG. 2, shown in a lockout position.
Figure 6:
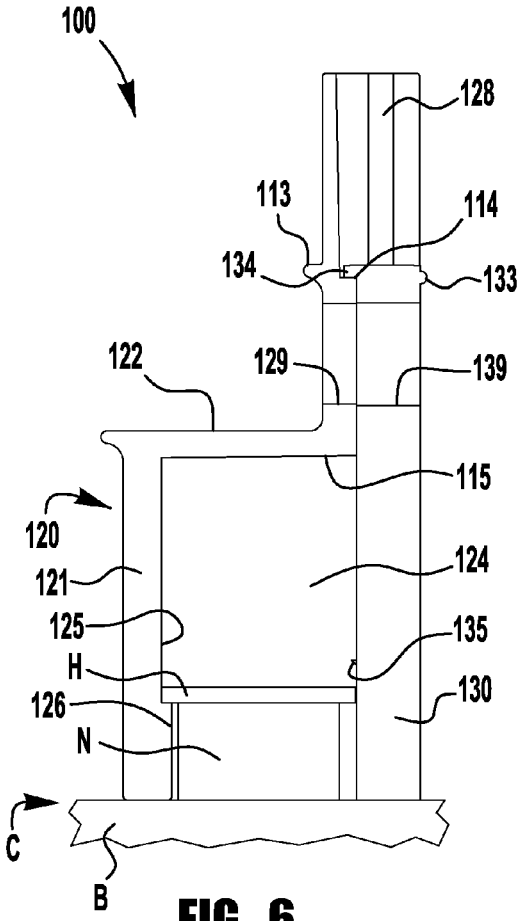
FIG. 6 is a side cross-sectional view of the lockout device of FIG. 2, shown in the lockout position and installed on an instrument.
Figure 7:
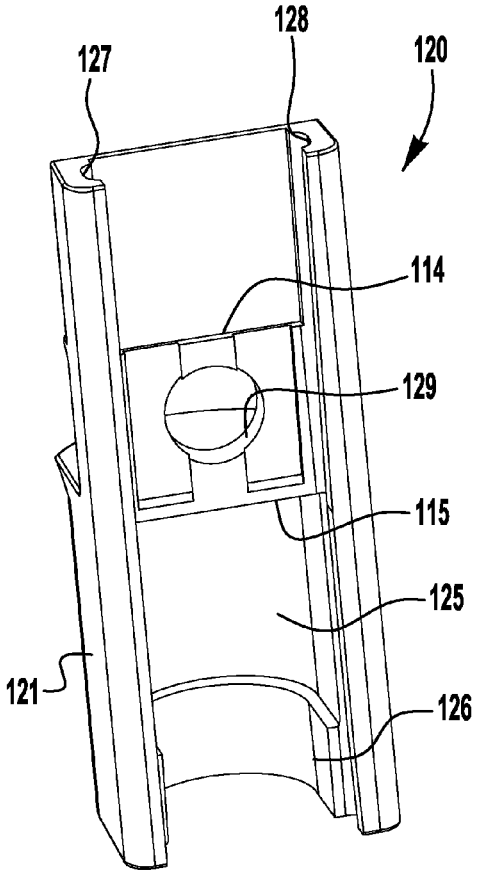
FIG. 7 is a perspective view of the housing of the lockout device of FIG. 2.
Figure 8:
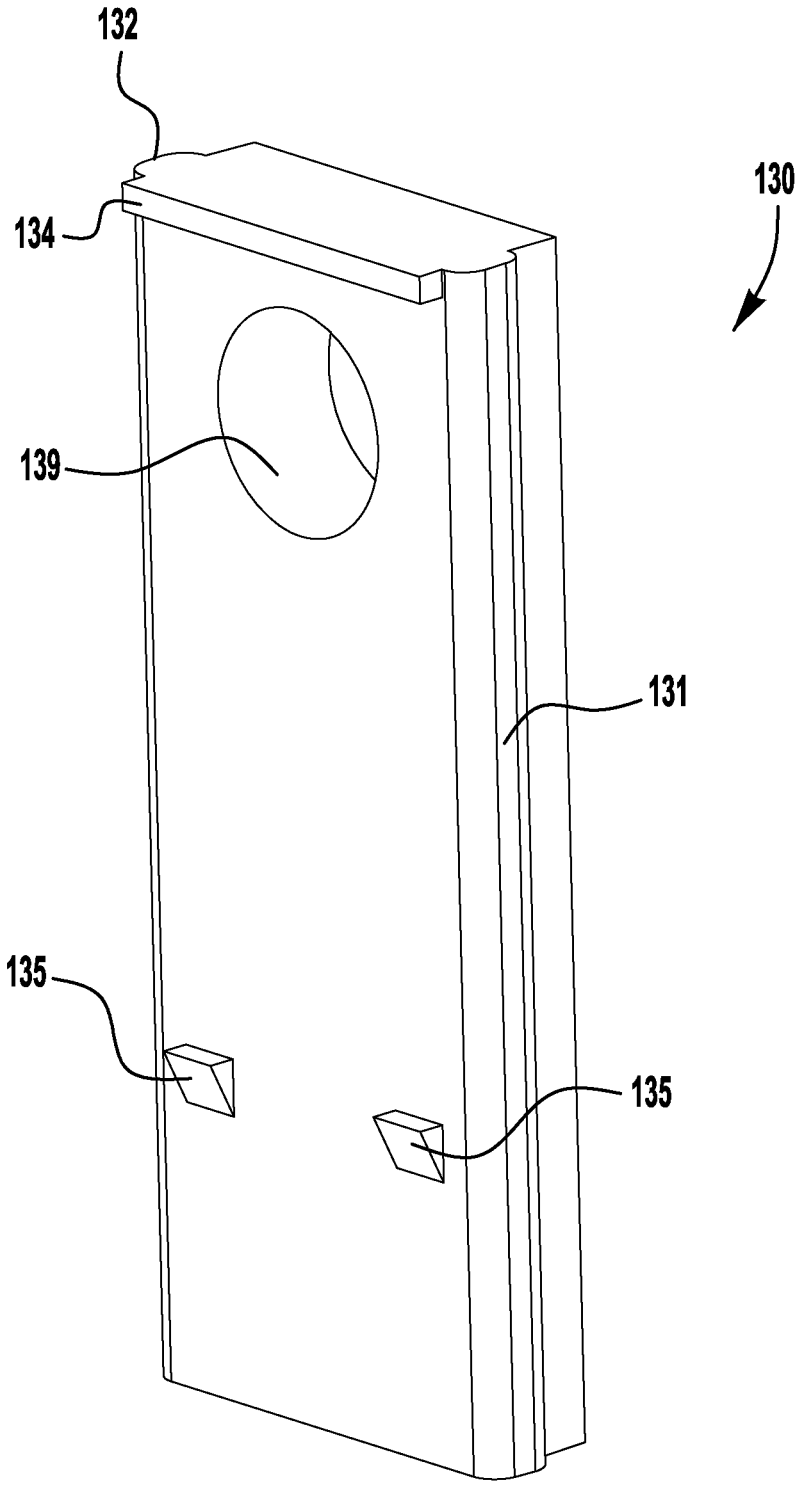
FIG. 8 is a perspective view of the cover of the lockout device of FIG. 2.
Figure 9:
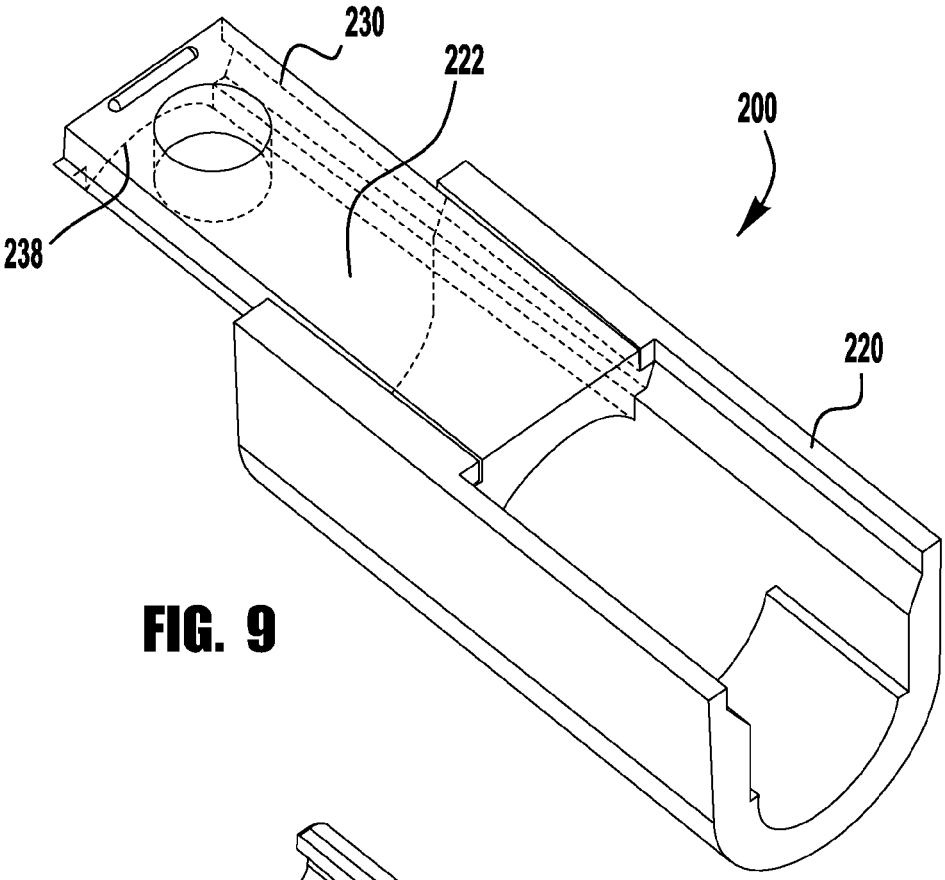
FIG. 9 is a perspective view of a lockout device according to another exemplary embodiment.

FIGS. 2-6 illustrate an exemplary lockout device 100 including a housing 120 and a sliding cover plate 130. The exemplary cover plate 130 is assembled with the housing 120 and is movable between a release position (e.g., instrument release) (FIGS. 2-4) and a lockout position (FIGS. 5 and 6). While any type of movable engagement between the housing and the cover plate may be used, in the illustrated embodiment, side edges 131, 132 of the cover plate 130 are received in grooves 127, 128 in first and second end portions of the side wall 121 of the housing 120. To provide positive stops for the cover plate 130, the cover plate may be provided with an upper flange 134 (or other such protrusion) that abuts an upper internal wall or shoulder 114 of the housing 120 when the cover plate 130 is in the lockout position (see FIG. 6), and one or more ribs 135 (or other such projections) that abut a lower internal wall 115 of the housing 120 when the cover plate 130 is in the release position. The cover plate 130 may be snap fit into engagement with the housing 120, or otherwise secured with the housing to provide a self contained assembly (for example, to prevent the cover plate 130 from being separated from the housing 120 and lost). As shown, the sides of the cover plate 130 may be fully retained in the housing grooves 127, 128 in both lockout and release positions, such that the cover plate does not extend beyond the housing in the release position. In another embodiment, as shown in FIG. 9, a lockout device 200 may include a cover plate 230 that extends beyond the housing 120 in the release position. Additionally, while the housing 120 may fully cover the locked out instrument, as shown in FIGS. 2-6, in another embodiment, as shown in FIG. 9, the housing 220 may alternatively include an upper opening 222 (or some other gap, notch, slot or open portion) that partially exposes a portion of the locked out instrument, for example, to facilitate identification of the instrument or a condition of the instrument.

The housing 120 includes a side wall 121 and end wall 122 and defines an opening 123 having a side facing first portion 123*a* and a downward facing second portion 123*b* sized to laterally receive the head and neck portions H, N of an instrument into an internal cavity of the housing 120. The opening 123 may be sized such that a head and neck portions H, N of a circuit breaker C (see FIG. 6) are laterally receivable through the side facing portion 123*a* of the opening 123 for retention of the head and neck portions of the circuit breaker C in an internal cavity 124 of the housing 120, with the neck portion N extending through the downward facing portion 123*b* of the opening 123. When the head and neck portions of the circuit breaker lockout device are received in the cavity 124 of the lockout device housing 120, the cover plate 130 may be slideable from the release position, shown in FIGS. 2-4, to the lockout position, shown in FIGS. 5 and 6. In the lockout position, the cover plate 130 blocks withdrawal of the head and neck portions H, N through the side portion 123*a* of the opening 123. To prevent withdrawal of the head and neck portions of the circuit breaker lockout device through the downward facing portion 123*b* of the opening 123, an inner peripheral projection 126 is positioned on or extends from an internal surface 125 of the side wall 121 of the housing 120 to engage the enlarged head portion H of the circuit breaker C and block the withdrawal of the head portion H. While the head portion H of an instrument C may be fully received in the housing cavity 124, as shown, in another embodiment (not shown), a locking cover may additionally define a cavity (e.g., with a contoured wall) to partially receive the head portion H of the instrument.

In the illustrated embodiment, the projection 126 forms an inner peripheral wall or shoulder having an upper surface that abuts an underside of the head portion H and a lower surface that that abuts a base portion B of the instrument C. In other embodiments, the projection need not extend to the bottom surface of the housing 120, as the bottom surface of the side wall abuts the base portion of the instrument. This structure may additionally prevent the head and neck portions H, N of the operable portion (e.g., a plunger or button) of the instrument C from being depressed or otherwise axially moved with respect to the base portion B when the lockout device 100 is in a lockout position. The projection 126 may also be sized to prevent installation of the lockout device 100 on a plunger-style circuit breaker in a closed or energized condition (with the head portion H depressed), by blocking insertion of the too closely spaced head portion H and base portion B into the cavity 124. In other exemplary embodiments, the projection 126 may be provided in a wide variety of sizes, shapes, and dimensions to accommodate a variety of instruments.

To secure the cover plate in the lockout position, either or both of the housing and the cover plate may include a lock interface that is engageable to secure the cover plate in the lockout position. The lockout interface may include an interface with a locking mechanism that is integral with the lockout device, such as, for example, a keyway of a key cylinder lock or one or more combination dials of a combination lock. In another embodiment, a lock interface may be configured to engage a separate lock member, such as, for example, a padlock shackle, to block movement of the cover plate out of the lockout position. In one such exemplary embodiment, a lock aperture may be provided in either or both of the housing and the cover plate, such that when a lock member (e.g., padlock shackle, locking cable, clip, etc.) is inserted through the aperture or apertures, sliding movement of the cover plate to the release position is blocked. In the illustrated embodiment, a lock aperture 129 of the housing 120 aligns with a lock aperture 139 of the cover plate 130 when the cover plate is in the lockout position (see FIGS. 5 and 6). Insertion of a lock member (e.g., a padlock shackle, not shown) through the aligned lock apertures 139, 129 prevents sliding movement of the cover plate 130 to the release position, in which the lock apertures 139, 129 are misaligned. The lock apertures 129, 139 may be sized and positioned to be fully misaligned in the release position, such that any size lock member inserted through the lock apertures (for example, a padlock shackle, cable, or zip tie) prevents movement of the cover plate 130 to the release position.

Figure 10:
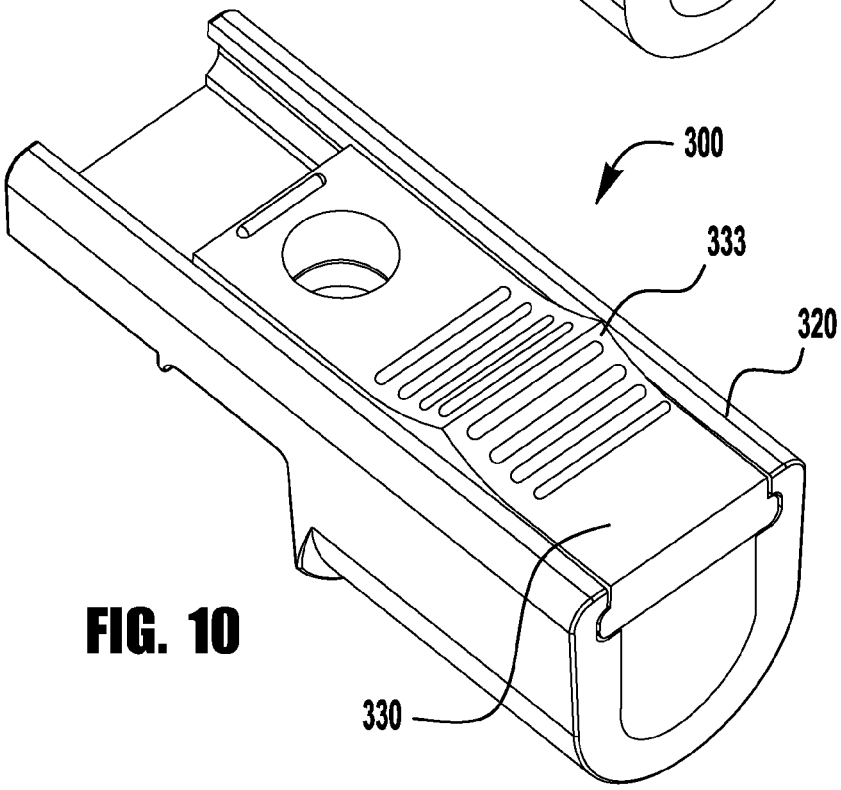
FIG. 10 is a perspective view of a lockout device according to another exemplary embodiment.

User engageable projections, such as ribs 113, 133 (see FIG. 5), may be provided on outer surfaces of the housing 120 and cover plate 130 to facilitate user movement of the cover plate 130. This may facilitate single hand operation of the lockout device 100 (for example, by grasping the housing 120 with the fingers and engaging and pushing the rib 133 with the thumb). Other user engageable projections or contours may additionally or alternatively be provided on one or both of the housing and the cover plate. For example, FIG. 10 illustrates a lockout device 300 having a cover plate 330 with a contoured elongated projection 333 to facilitate engagement with a user's thumb or finger.

Still other features may be provided with a lockout device, as described in the present application. For example, the body 120 may be provided with an outer surface 111 (see FIG. 3) adapted to receive a warning label or lockout tag. As still another example, one or both of a housing and a cover may include a transparent material to allow a user to observe a condition or characteristic of a locked out instrument. As another example, as shown in FIG. 9, the cover plate 230 may be provided with a contoured inner surface 238, for example, to provide a closer fit between the lockout device 200 and the locked out instrument.

Figure 11:
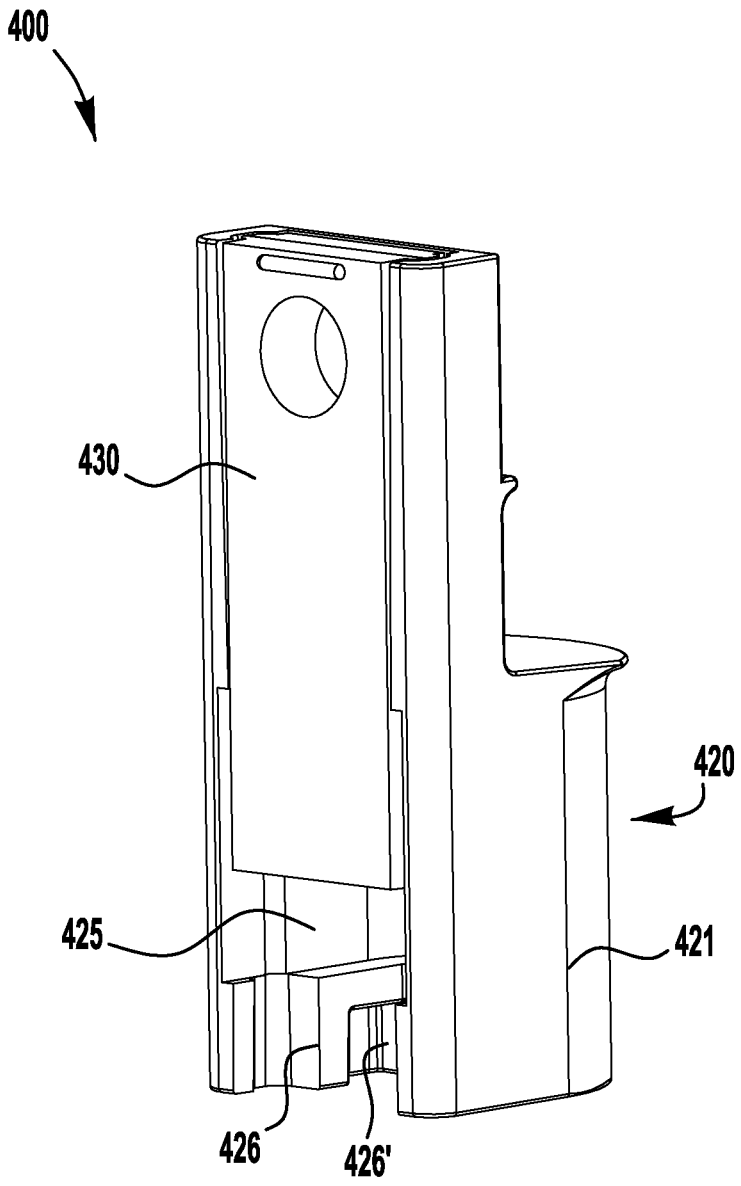
FIG. 11 is a perspective view of a lockout device according to another exemplary embodiment.

Lockout devices in accordance with the present application may be provided in a variety of sizes and configurations to accommodate a variety of instruments. For example, lockout devices may be provided with different sized cavities and projections to accommodate different sized instruments, for example, plunger-style circuit breakers having different length necks. As one example, as shown in FIG. 11, a lockout device 400 may include a housing 420 with an enlarged side wall portion 421 and a thicker or larger protrusion 426 extending from an internal surface 425 of the side wall portion 421, to accommodate instruments having larger or wider head portions (e.g., a plunger-style circuit breaker having an enlarged collar attachment, not shown). The protrusion 426 may be provided with gaps or notches 426' that reduce material usage while still providing a protrusion of sufficient height, strength, and rigidity. Lockout devices in accordance with the present application may also be provided in a variety of materials, including, for example, electrically insulating materials such as molded or machined plastic (e.g., polyethylene, polypropylene).

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, components, form, fit and function, etc.—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention.

What is claimed is:

1. A circuit breaker lockout device for assembly with a circuit breaker having a base portion, a neck portion extending in a longitudinal direction from the base portion, and a head portion extending in a lateral direction from a distal end of the neck portion, the lockout device comprising:

a housing including a side wall at least partially defining an internal cavity sized to receive the head portion of the instrument, and a protrusion extending from an internal surface of the side wall and positioned to retain the head portion within the internal cavity when the head portion of the instrument is received in the internal cavity, the housing defining an opening having a laterally facing first portion sized to receive the head portion of the instrument and a downward facing second portion sized to receive the neck portion of the instrument;

a cover assembled with the housing and slideable with respect to the housing in the longitudinal direction between a lockout position at least partially blocking the first portion of the opening to secure the head portion of the instrument within the internal cavity, and a release position permitting withdrawal of the head portion of the instrument through the first portion of the opening; and a lock interface configured for securing the cover in the lockout position.

2. The circuit breaker lockout device of claim 1, wherein the lock interface comprises a first lock aperture in the housing and a second lock aperture in the cover, the first and second lock apertures being aligned to receive a lock member when the cover is in the lockout position.

3. The circuit breaker lockout device of claim 2, wherein the first and second lock apertures are misaligned when the cover is in the release position.

4. The circuit breaker lockout device of claim 1, wherein the cover comprises a plate.

5. The circuit breaker lockout device of claim 4, wherein first and second side edges of the plate are slideably retained within first and second grooves in the side wall.

6. The circuit breaker lockout device of claim 4, wherein the plate comprises a first protrusion that abuts the housing when the cover is in the lockout position and a second protrusion that abuts the housing when the cover is in the release position.

7. The circuit breaker lockout device of claim 6, wherein the first and second protrusions prevent disassembly of the plate from the housing.

8. The circuit breaker lockout device of claim 4, wherein the side wall of the housing is sized such that the plate does not extend beyond a distal end of the housing when the cover is in the release position.

9. The circuit breaker lockout device of claim 1, wherein the housing protrusion is sized and positioned to prevent longitudinal movement of the head portion of the instrument with respect to the base portion of the instrument when the lockout device is assembled with the instrument.

10. The circuit breaker lockout device of claim 1, wherein the housing further comprises an end wall at least partially covering the head portion of the instrument when the lockout device is assembled with the instrument.

11. The circuit breaker lockout device of claim 1, wherein the housing further comprises an upper opening that at least partially exposes the head portion of the instrument when the lockout device is assembled with the instrument.

12. In combination, an instrument and a lockout device, the instrument extending from a control panel and including a head portion extending in a lateral direction from a neck portion, the instrument being movable with respect to the control panel, the lockout device comprising:

a housing including a side wall at least partially defining an internal cavity receiving the head portion of the instrument, and a protrusion extending from an internal surface of the side wall, the head portion being retained within the internal cavity by the protrusion, the housing defining an opening having a laterally facing first portion sized to permit withdrawal of the head portion of the instrument and a downward facing second portion receiving the neck portion of the instrument therethrough;

a cover assembled between first and second portions of the side wall and slideable in a longitudinal direction between a lockout position at least partially blocking the first portion of the opening to secure the head portion of the instrument within the internal cavity, and a release position permitting withdrawal of the head portion of the instrument through the first portion of the opening;

wherein at least one of the housing and the cover includes a lock aperture positioned to receive a lock member when the cover is in the lockout position to secure the cover in the lockout position.

13. The combination of claim 12, wherein the cover comprises a plate having first and second side edges slideably retained within first and second grooves in the first and second portions of the side wall.

14. The lockout device of claim 12, wherein the cover comprises a first protrusion that abuts the housing when the cover is in the lockout position and a second protrusion that abuts the housing when the cover is in the release position.

15. The lockout device of claim 14, wherein the first and second protrusions prevent disassembly of the cover from the housing.

16. The lockout device of claim 12, wherein the side wall of the housing is sized such that the cover does not extend beyond a distal end of the housing when the cover is in the release position.

17. The lockout device of claim 12, wherein the housing protrusion is sized and positioned to block movement of the instrument toward a retracted position.

18. A method of preventing movement of an instrument with respect to a control panel, the method comprising:

inserting a head portion of the instrument through a laterally facing first portion of an opening in a housing of a lockout device, such that the head portion of the instrument is received in an internal cavity in the housing and a neck portion of the instrument extends through a downward facing second portion of the opening, wherein a protrusion extending from an internal surface of the side wall blocks withdrawal of the head portion through the second portion of the opening;

sliding a cover assembled with the housing in a longitudinal direction to a lockout position in which the cover plate at least partially blocks the first portion of the opening to prevent withdrawal of the head portion of the instrument through the first portion of the opening; and securing a lock member through a lock aperture in at least one of the housing and the cover to secure the cover in the lockout position.

19. The method of claim 18, wherein the protrusion is sized and positioned to block movement of the instrument from an extended position to a refracted position.

20. The method of claim 18, wherein securing the lock member through a lock aperture in at least one of the housing and the cover comprises securing the lock member through aligned lock apertures in the housing and cover.

21. The method of claim 18, further comprising:

removing the lock member from the lock aperture;

sliding the cover to a release position; and removing the head portion of the instrument from the housing of the lockout device.

22. A lockout device for assembly with an instrument of an electromechanical device, the instrument having a base portion, a neck portion extending in a longitudinal direction from the base portion, and a head portion extending in a lateral direction from a distal end of the neck portion, the lockout device comprising:

a housing including a side wall at least partially defining an internal cavity sized to receive the head portion of the instrument, and a protrusion extending from an internal surface of the side wall and positioned to retain the head portion within the internal cavity when the head portion of the instrument is received in the internal cavity, the housing defining a laterally facing opening;

a cover assembled with the housing and slideable with respect to the housing in a longitudinal direction between a lockout position at least partially blocking the opening to secure the head portion of the instrument within the internal cavity, and a release position permitting withdrawal of the head portion of the instrument through the opening; and a lock interface configured for securing the cover in the lockout position.

23. The lockout device of claim 22, wherein the lock interface comprises a first lock aperture in the housing and a second lock aperture in the cover, the first and second lock apertures being aligned to receive the locking device when the cover is in the lockout position.

24. The lockout device of claim 22, wherein the cover comprises a plate having first and second side edges slideably retained within first and second grooves in first and second portions of the side wall.

* * * * *